United States Patent [19]

Lange et al.

[11] Patent Number: 4,493,166

[45] Date of Patent: Jan. 15, 1985

[54] ULTRA PRECISE TOOL FORMING APPARATUS

[75] Inventors: Howard G. Lange, Prospect Heights; Francis M. Ray, Schaumburg, both of Ill.

[73] Assignee: Zenith Electronics Corporation, Glenview, Ill.

[21] Appl. No.: 432,475

[22] Filed: Oct. 4, 1982

[51] Int. Cl.[3] ..... B24B 17/02

[52] U.S. Cl. ..... 51/100 R; 51/34 R; 51/124 R

[58] Field of Search ..... 51/100 R, 124 R, 34 R, 51/34 H, 46, 96, 34 A, 166 R; 308/5 R; 384/99

[56] References Cited

U.S. PATENT DOCUMENTS

| | | | |
|---|---|---|---|
| 1,927,977 | 9/1933 | Flygare | 51/34 H |
| 3,030,744 | 4/1962 | Mueller | 51/225 |
| 3,137,104 | 6/1964 | Banko | 51/166 R |
| 3,180,062 | 4/1965 | Aller | 51/166 R |
| 3,368,310 | 2/1968 | Garvey | 51/100 R |
| 3,744,858 | 7/1973 | Weichsel | 308/5 R |

*Primary Examiner*—Robert P. Olszewski
*Assistant Examiner*—Matthew D. Daschel
*Attorney, Agent, or Firm*—Cornelius J. O'Connor

[57] ABSTRACT

This invention is concerned with ultra precise apparatus for forming a complex profiled face on a diamond tool blank. The apparatus comprises an abrading device in the form of a grinding wheel and a spindle means which includes a journal for supporting the grinding wheel. This journal is rotatably supported upon an air bearing. A platform, supported for rotation about a vertical pivot axis, is also supported for displacement in a horizontal plane along an axis perpendicular to the pivot axis. An air bearing supports the platform for rotation about the pivot axis while another air bearing supports the platform for displacement in the horizontal plane perpendicular to that axis. A tool chuck is mounted upon the platform and serves to present the tool blank to the grinding wheel. A cam, mounted adjacent to the platform, is provided with a surface whose contour is related to the complex profiled face to be formed on the tool blank. A cam follower is supported by the platform for engagement with the contoured cam surface. A micrometer device, in response to displacement of the cam follower by the cam surface, selectively positions the platform along an axis intersecting the pivot axis. Finally, means are provided for rotating the platform about its pivotal axis and for simultaneously effecting a relative travel of the cam follower along the cam surface, while the tool blank is presented to the grinding wheel, thus causing the grinding wheel to generate a complex profiled face on the tool blank.

6 Claims, 12 Drawing Figures

ULTRA PRECISE TOOL FORMING APPARATUS

BACKGROUND OF THE INVENTION AND PRIOR ART STATEMENT

This invention relates, in general, to ultra precise apparatus for fabricating a diamond tool and is particularly concerned with a machine for forming a complex profiled face on such a tool.

Precision diamond tools are typically formed by mounting a diamond blank in a tool holder and then presenting the blank to a grinding device, such as a diamond wheel, which is supported for high speed rotation. The blank is brought to bear against the surface of the wheel until a desired profile is formed on the face of the blank. By and large this is a manual operation entailing countless passes of the blank against the cutting wheel in attempting to match the desired profile.

A diamond tool of the type herein considered finds particular application in fashioning the tooling required to form intricately contoured molds, such as the mold used for producing a projection television screen of the type characterized by a multiplicity of lenticules disposed in a precision array for the purpose of directing and focusing the television image projected thereon toward a viewer. Such a projection screen is disclosed in copending application Ser. No. 265,938 which was filed on May 21, 1981 in the name of Howard G. Lange, which application is assigned to the same assignee as the present invention. Any imperfections in forming the screen will result in a readily discernible degradation of the image or, reduced or uneven brightness due to uneven distribution of the image light through the screen. Accordingly, the tool for forming the mold master must be very precise; in practice, the tool should have a tolerance in the order of a few microinches. Prior art diamond tool forming arrangements have failed to provide the precision desired.

U.S. Pat. No. 3,813,818-Hayashi et al disclose a profile grinder which has an abrasive grinding wheel adapted to move laterally for controlling the depth of abrasion in response to a follower maintained in contact with a template.

Ulfves discloses in U.S. Pat. No. 2,716,851 a cam controlled work holder. Its contribution to the art is said to reside in the use of extra cams to permit grinding of tapers, angles, ovals, etc. However, the structure and method of operation of the aforementioned disclosures is very different from our invention, and neither is capable of achieving the precision grinding attainable by the apparatus described herein. Other prior art uncovered in a search included U.S. Pat. No. 3,251,157 and U.S. Pat. No. 4,068,413 which also were studied but deemed inapplicable to the invention described herein.

OBJECTS OF THE INVENTION

It is, therefore, a general object of the invention to provide improved apparatus for the precision forming of diamond tools.

It is also an object of the invention to provide means for forming precision diamond tools, which means are essentially automatic in operation.

It is a specific object of the invention to provide diamond grinding apparatus capable of forming diamond tools to a tolerance of five to ten microinches.

It is a more specific object of the invention to provide means for the precision forming of diamond tools used in the fabrication of molds for linear lenticulated projection television screens.

BRIEF DESCRIPTION OF THE DRAWINGS

The features of the present invention which are believed to be novel are set forth with particularity in the appended claims. The invention, together with further objects and advantages thereof, may best be understood by reference to the following description, taken in conjunction with the following drawings, in the several figures of which like reference numerals identify like elements and in which:

DESCRIPTION OF THE PREFERRED EMBODIMENT

Figure 1:
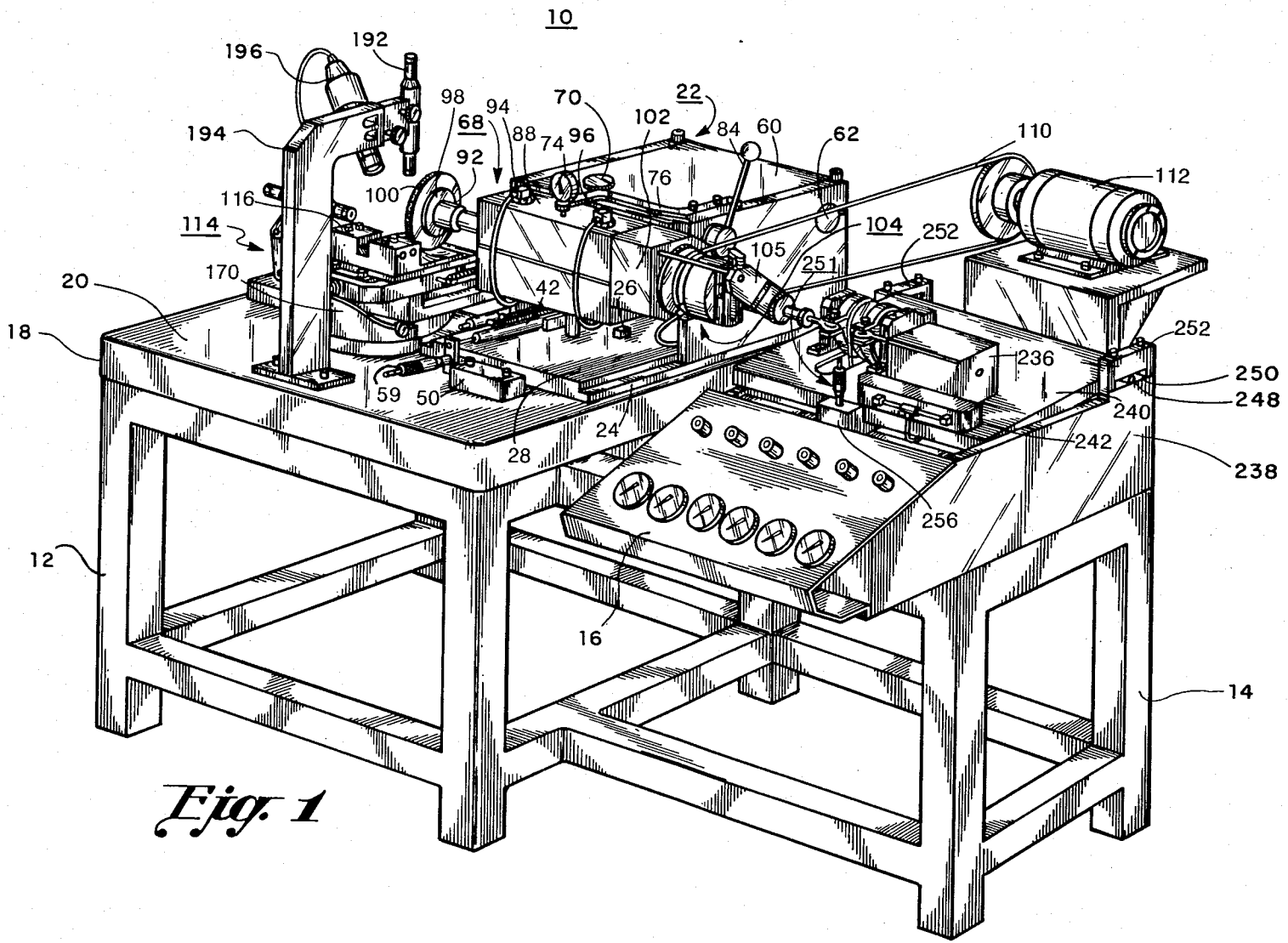
FIG. 1 is an overall perspective view of a diamond tool forming apparatus constructed in accordance with the invention.

Referring now to FIG. 1, an ultra precise apparatus 10 for forming a complex profiled face on a diamond tool blank comprises a machine base 12 for supporting the grinding apparatus and an extension 14 of the base upon which a control panel 16 and auxiliary apparatus, described below, are mounted. It is appreciated, of course, that the invention contemplates grinding tool blanks of material other than diamond in that the thrust of the invention is addressed to forming complexly profiled high precision tools.

In order to ensure precise grinding operations, a standard surface plate 18, in the form of a granite block is secured atop base 12. The upper face 20 of block 18 is ground flat so that any apparatus, fixtures, etc., mounted thereon will maintain, indefinitely, preassigned elevations and orientations.

Figure 2:
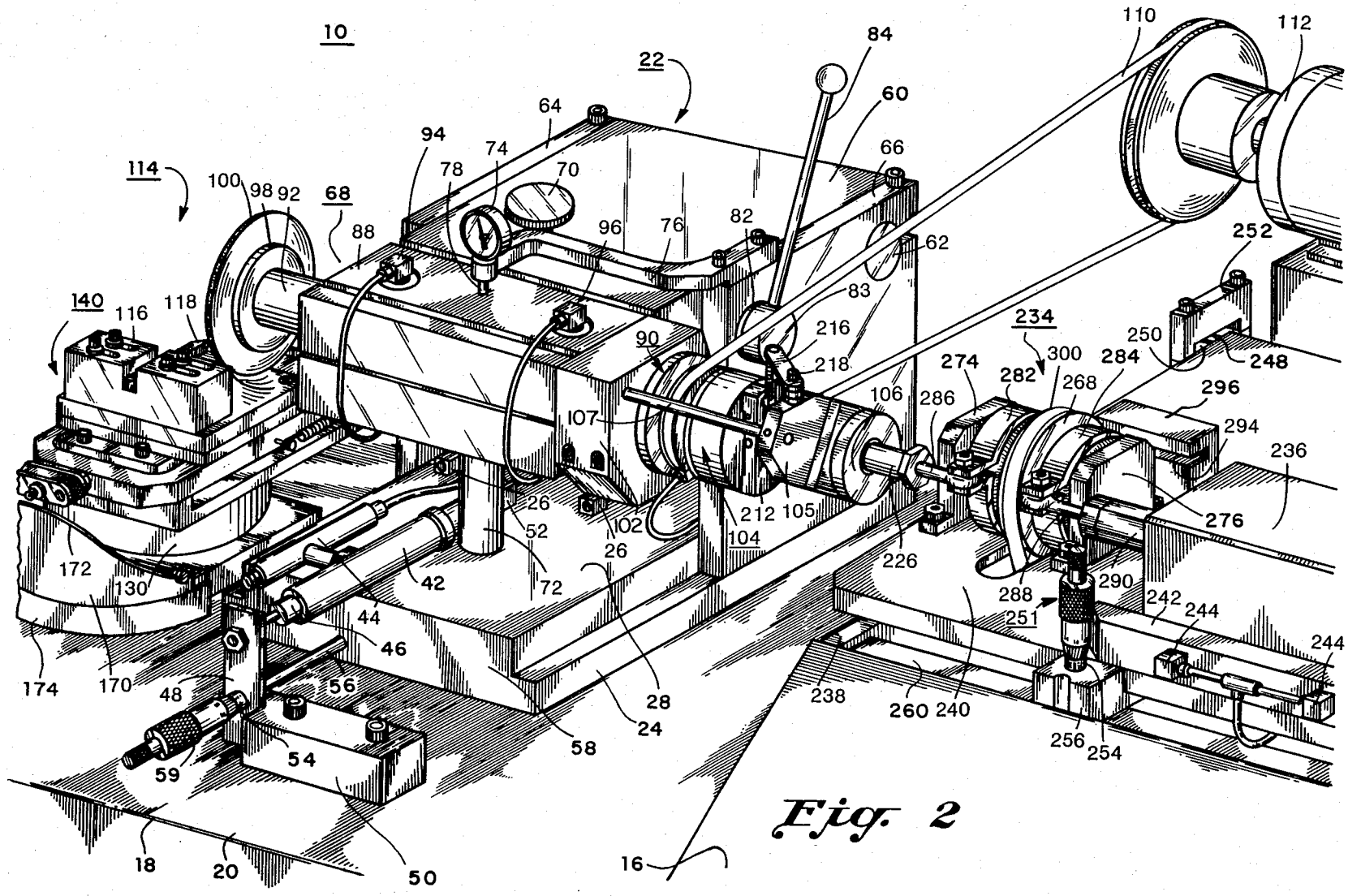
FIG. 2 is a perspective view that focuses on the spindle assembly of the apparatus shown in FIG. 1.

A basic element of precision grinding apparatus 10 is the wheelhead assembly 22 featured in FIG. 2. This assembly is mounted on a base plate 24 which, during operation, may be borne upon a gaseous lubricant. In an embodiment of the invention which has been reduced to practice, a film of air is used as the gaseous lubricant to create an air bearing to support the wheelhead assembly. However, it is to be noted that, in all instances herein where reference is made to air bearings, it is appreciated that a gaseous lubricant, other than an air film, can be employed to establish such bearings.

In any event, compressed air, from a suitable source, is introduced through a series of ports 26 fitted to the top surface 28 of baseplate 24, two of which can be seen in FIG. 2. These ports communicate with apertures, not shown, that extend through the baseplate and exit at its bottom surface. In this fashion, an air bearing is created between face 20 of the granite block 18 and the underside of base plate 24 and is maintained by suitable control means accessed from panel 16.

Figure 3:
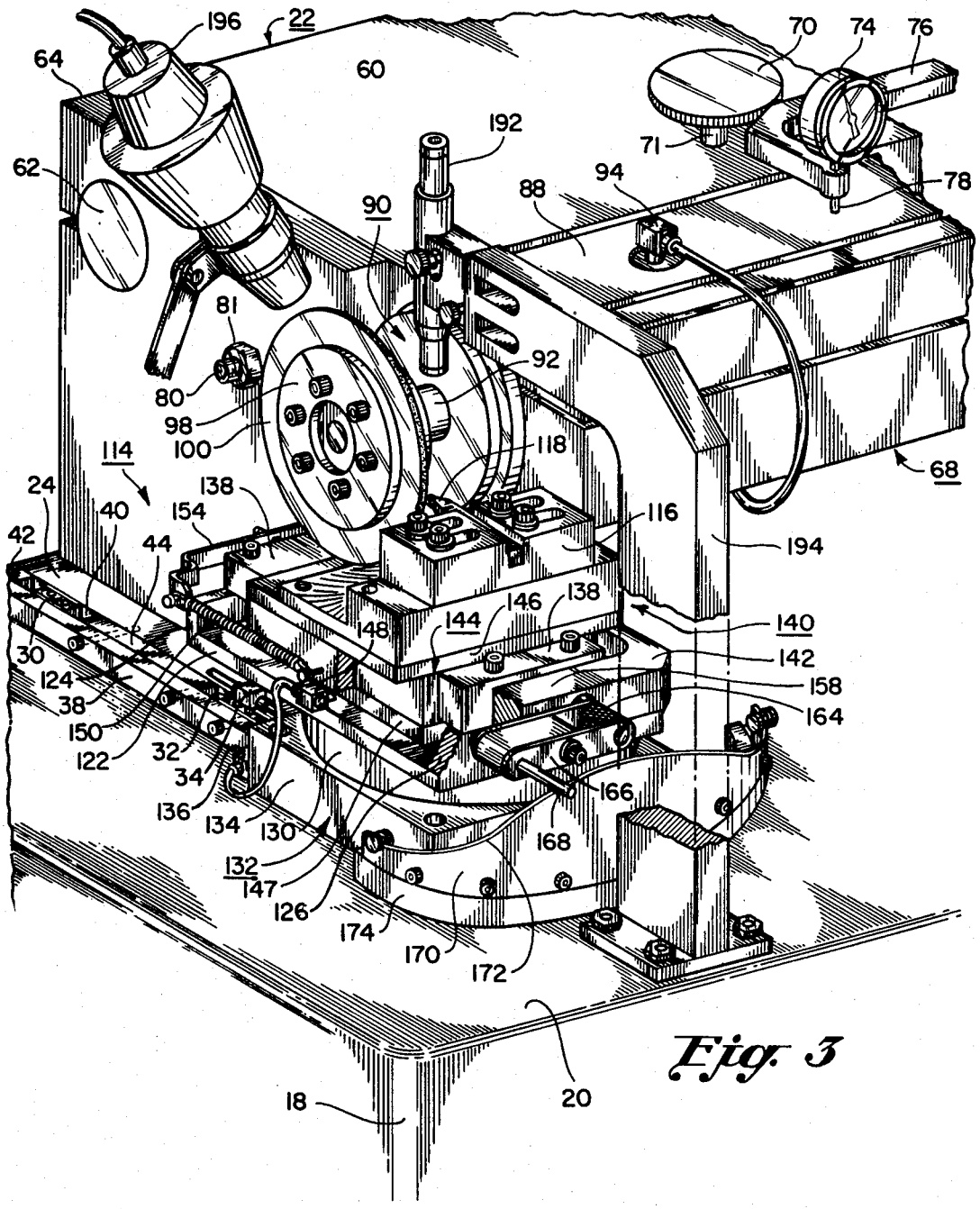
FIG. 3 is a perspective view depicting the apparatus shown in FIG. 1.

While supported upon its air bearing, the wheelhead assembly is restricted to longitudinal displacement only, that is, in a direction lying in the plane of surface 20 of block 18 and perpendicular to rotary axis of spindle assembly 90, by a captivating arrangement best seen in FIG. 3. More particularly, that arrangement comprises a pair of keys 30, 32 having air inlet ports 34. In order to show the detail of key 30, its inlet port has been omitted. Each of keys 30, 32 is provided with lateral air outlet apertures, which are not shown. The keys are anchored to face 20 of the granite block by conventional fasteners. A bar 38, which is bolted to the sidewall 40 of baseplate 24 through a series of spacers 42, 44 and 46, serves to captivate baseplate 24 about keys 30, 32. The thickness of the three spacers is selected to be slightly greater than the thickness of the two keys, in practice, a difference of one one-thousandth inch, so that minute clearance exist between bar 38 and the keys, as well as between the keys and sidewall 40 of the baseplate. Accordingly, with this arrangement, the aforementioned lateral air outlet apertures of keys 30, 32 serve to create air bearings between one side of each of the keys and bar 38 and between the opposite side of each key and sidewall 40. As a result, baseplate 24 is provided with a lateral air bearing, in addition to the air bearing established between its underside and face 20 of the granite block.

Baseplate 24, as well as the wheelhead assembly it supports, is maintained in a desired operating position on granite block 18, relative to a workpiece station (to be described), by a biasing arrangement comprising an air cylinder 42 which is activated by a valve 44 connected to an air source, see FIG. 2. One end of the displaceable piston 46 of the air cylinder is fixed to an upright tab 48 extending from a foot 50 which is fastened to face 20 of the granite block. The distal end of cylinder 42, in turn is pivotally anchored to surface 28 of the faceplate by the bracket 52. The barrel 54 of a micrometer 54is also mounted on tab 48 with its extendable spindle 56 bearing against the end wall 58 of baseplate 24. Thus, when air cylinder 42 is energized, baseplate 24 is brought to bear against spindle 56 which, of course, is axially displaceable by adjusting the thimble 59 of the micrometer to select a desired operating position for the entire wheelhead assembly supported by the baseplate.

Referring again to FIG. 2, as well as FIG. 3, assembly 22 is seen to include a wheelhead 60 that is fitted to a shaft 62 which, in turn, is rotatably received by apertured end walls 64, 66. As shown, these end walls are vertically mounted upon base plate 24. Affixed to the front of wheelhead 60 is the grinding spindle assembly 68. Located immediately behind this spindle assembly is a height adjuster which takes the form of a knurled cap 70 having a depending stem 71, see FIG. 3, which is threadably captured in wheelhead 60. The lower end of stem 71 bears against the top of an upright wheelhead post 72, which is fixed to base plate 24. Since the stem is adjustable, it constitutes a means for controlling the elevation of the wheelhead and, of course, spindle assembly 68. An elevation gauge 74, mounted upon a bracket 76 bolted to end wall 66, is suspended over the spindle assembly with its spring-loaded measuring pin 78 abutting the top of that assembly.

To maintain a selected elevation of wheelhead 60 and spindle assembly 68, relative to the workpiece station, as well as to permit elevation adjustments, a releasable friction clamp is provided. Specifically, one end of a threaded bar 80, see FIG. 3, is anchored to end wall 64 by a nut 81. The body of the bar, not shown, extends through an enlarged bore in wheelhead 60 passing its other end through a washer 82 to a suitably threaded clamp nut 83, see FIG. 2. This nut is fitted with an arm 84 of sufficient length to afford the necessary clamping torque. Actually, the end walls 64, 66 and wheelhead 60 are machined to such extremely close tolerances, that the spacings between those walls and the wheelhead are minute. Accordingly, very little travel of the clamp nut 83 along the threaded bar 80 is required to effect a clamping engagement, or disengagement, between the wheelhead and the end walls. Moreover, since the range of wheelhead elevation required in practice is relatively small, the bore in the wheelhead need only be large enough to accommodate clamping bar 80 and the expected elevational travel of the wheelhead.

The spindle assembly 68 comprises a housing 88 that encloses and supports the grinding spindle air bearing assembly 90, see FIG. 3. Centrally disposed within assembly 90 is a spindle means comprising a journal 92 which is rotatably supported upon a gaseous lubricant in the form of an air film which is maintained between the journal and a close fitting surrounding sleeve, not shown, mounted within assembly 90. The air for this bearing is supplied through a pair of hoses to the inlets 94, 96 fitted to the top of housing 88. As viewed in FIG. 3, the left end of shaft 92 is fitted with a hub 98 that demountably supports an abrading device 100, which can take the form of a grinding wheel containing diamond grit. On the other hand, if desired, device 100 can comprise a lapping wheel of a suitable material for lapping following grinding. In any event, and as will be seen, due to the stiffness of the air bearing supporting spindle journal 92, as well as other air bearings to be described, grinding wheel 100 is maintained in a very precise spatial relationship to the workpiece with which it is to be associated.

The right end of assembly 90, as viewed in FIG. 2, is fitted with a collar 102 which serves to support and maintain a thrust air bearing 104, a spherical bearing bracket 105 and a skew limiter 106 is a desired operative relation to the driven end of the spindle journal 92. In part, this support is afforded by a pair of tie bars 107 which rigidly secure bracket 105 to collar 102, see FIG. 4. Air bearing 104, bracket 105 and skew limiter 106 are described in greater detail below. The tapered driven end 109 of spindle journal 92, that is, the end remote from grinding wheel 100, has a drive pulley 108 secured thereon by the nut 103 fitted to the threaded extremity of journal 92. Pulley 108 is coupled via a belt 110 to an electric motor 112.

Figure 5:
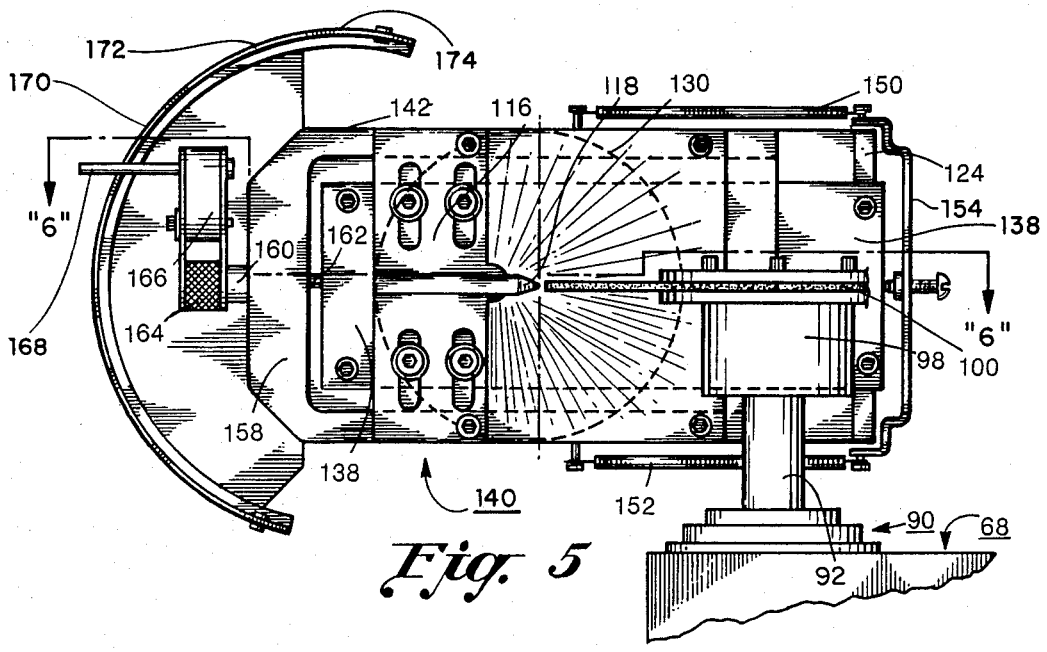
FIG. 5 is a top view of the workpiece station shown in FIG. 3.
Figure 9:
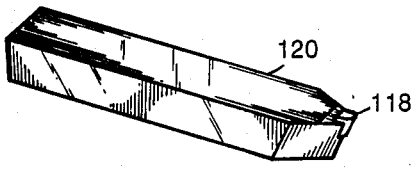
FIG. 9 is a perspective view of a diamond tool and its holder.
Figure 9A:
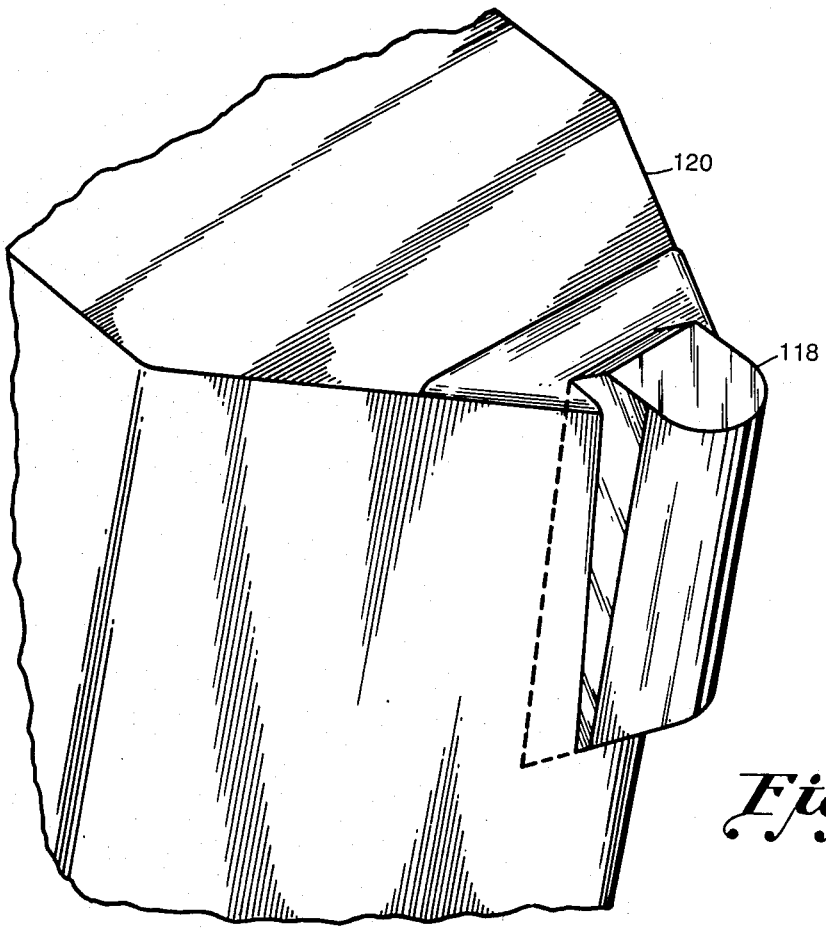
FIG. 9*a* is an enlargement of the diamond tool shown in FIG. 9 depicting the complex profiled face of the diamond tool.

Positioned immediately adjacent grinding wheel 100 is the previously alluded to workpiece station 114, which is surmounted by a tool chuck 116 that releasably secures and presents a diamond tool blank 118 to grinding wheel 100, see FIGS. 3 and 5. Insofar as details of the tool blank are concerned, reference is made to FIGS. 9 and 9*a*, which show that the tool blank 118 itself is secured in a shank 120, as by brazing, and it is this shank that is releasably mounted in tool chuck 116. As will be shown, the work station is supported for rotation about a predetermined axis, hereinafter referred to as the pivot, or P, axis. Preferably, this pivot axis is selected to be perpendicular to the axis of spindle journal 92 and coincides with the axis of an air bearing spindle now to be described.

Figure 6:
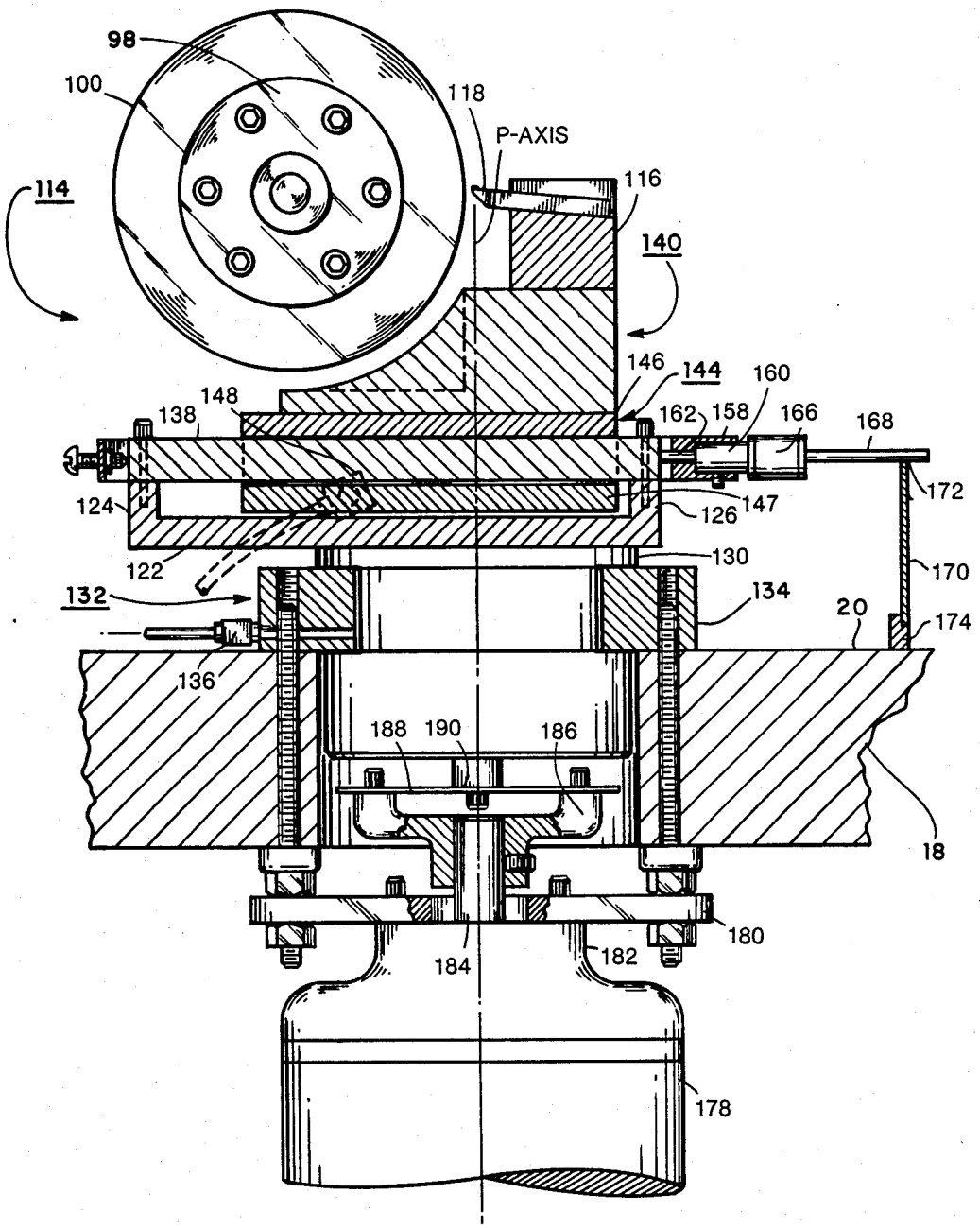
FIG. 6 is a sectional view of the workpiece station taken along lines "6"—"6" in FIG. 5.

Referring now to FIGS. 3 and 6, station 114 is seen to comprise a bed 122 having upright end walls 124 and 126, which bed is secured to the upper end face of the rotatable spindle 130 of an air bearing 132. It is the axis of spindle 130 that establishes the aforesaid pivot axis. Bearing 132 includes a shoulder 134 which serves to mount the bearing assembly on surface 20 of granite block 18 with spindle 130 vertically disposed and with its end face extending above surface 20. Shoulder 134 is fitted with an appropriate air inlet port 136, which serves to create a vertically oriented air film that surrounds spindle 130. This spindle is also supported upon a radially extending air film which film is also established within shoulder 134. The aforesaid air films enable workpiece station 114 situated atop spindle 130 to freely rotate, with minimal friction and run-out, about the aforesaid P axis.

A beam 138 spans the end walls 124, 126 of bed 122 an is anchored to those walls, see FIG. 6. A movable platform 140, supported for displacement in a two-dimensional plane disposed perpendicular to the above-mentioned P axis, is suspended, in a manner to be described, upon a plurality of air films generated about beam 138. More particularly, platform 140 is comprised of a U-shaped yoke 142, which straddles three sides of beam 138, and a four-sided chamber 144 that surrounds the beam, see FIG. 3. The upper panel 146 of the chamber spans the parallel legs of yoke 142 and is fastened to those legs. Moreover, as shown in FIGS. 3 and 6 it is to panel 146 of chamber 144 that tool chuck 116 is secured. In any event, top panel 146, bottom panel 147 and two side panels complete chamber 144.

Mobility for platform 140 is facilitated by virtue of the fact that the walls of chamber 144 are minutely spaced from the confronting sides of beam 138 so that the chamber and the beam comprise the basic constituents of an air bearing. Specifically, air under pressure is introduced via port 148 to one of the side walls of chamber 144 which, in turn, communicates pressurized air to the other side walls, all of which side walls have air outlet apertures on their surfaces that confront beam 138. When chamber 144 is thus energized, air films are created between the four inside walls of the chamber and the adjacent surfaces of beam 138 which, at any given time, are surrounded by chamber 144. Accordingly, platform 140 is shown to be supported for rotation about the vertical pivot axis P, as well as for displacement in a two-dimensional horizontal plane disposed perpendicular to the pivot axis.

To facilitate presentation of diamond blank 118 to the grinding wheel, platform 140 is constantly urged toward the wheel by the biasing arrangement best seen in FIGS. 3 and 5. As depicted therein, one end of each of a pair of springs 150, 152 is hooked to a bracket 154 which, in turn, is pivotally mounted to the far end of beam 138 in whiffletree fashion. The other end of each of springs 150, 152 is pinned to the immediately adjacent leg of yoke 142. This mounting arrangement enables bracket 154 to maintain the biasing force exerted upon platform 140 coincident with the longitudinal axis of beam 138. Accordingly, when air bearings are established between beam 138 and chamber 144, platform 140 effectively floats so that it and tool chuck 116, under the pressure exerted by springs 150, 152, are driven in a direction such that the tool blank 118 supported by the chuck is urged into an abrading or grinding contact with wheel 100.

In order to select the position of the tool blank, relative to the grinding wheel, means in the form of a platform control arrangement is provided for selectively positioning the platform in a plane perpendicular to the pivot axis. More particularly, and as best seen in FIGS. 3, 5 and 6, this control arrangement adopts a micrometer drive format in which the barrel 160 of such an instrument is rigidly secured in the bight section 158 of the yoke. The distal end of the micrometer spindle 162 is disposed in an abutting engagement with that end of beam 138, see FIG. 5, that confronts bight section 158. Accordingly, when the thimble 164 of the micrometer is rotated in such a direction as to retract, spindle 162, springs 150, 152 draw platform 140 radially inward toward the grinding wheel bringing the tool blank into abrading contact with the wheel. On the other hand, when the micrometer thimble is rotated in the opposite direction, spindle 162 is extended and, since it bears against beam 138, a fixed object, platform 140 is driven back from the beam thus withdrawing the tool blank from the grinding wheel.

For reasons soon to be made apparent, thimble 164 is fixed to one end of a crank 166, the other end of which is fitted with a drive pin 168. Suffice it to note at this juncture, that raising or lowering driven pin 168 will serve to rotate micrometer thimble 164 thereby withdrawing or extending spindle 162. As a result, the micrometer controls the radial excursions of platform 140, relative to the pivot axis P.

Figure 7A:
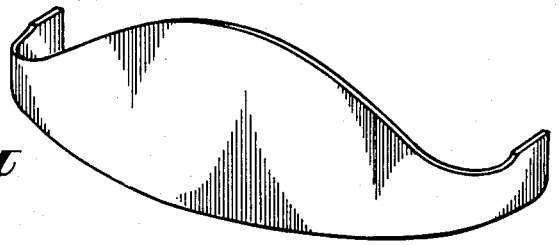
FIGS. 7*a* and 7*b* depict two of a variety of cam configurations that can be employed in the workpiece station shown in FIGS. 3 and 5.
Figure 7B:
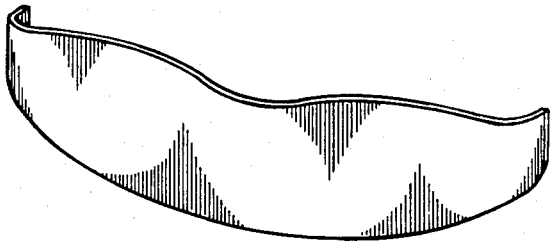

From the above-described arrangement for displacing platform 140 in a horizontal plane, it is manifest that such displacement can be achieved manually by rotating micrometer thimble 164, as by lifting pin 168. However, it is contemplated by the invention that such displacement is to be achieved, automatically, by cam means disposed adjacent platform 140. More particularly, this means comprises a cam 170 having a surface 172, the contour of which is established by a computer aided design in which an algorithm representative of the complex profile face desired for the tool blank is converted by the computer into the desired contour. Two examples of such cam contours are shown in FIGS. 7*a* and 7*b*. Cam 170 is mounted in a holder 174 which is anchored to the top surface 20 of granite block 18. Cam holder 174 is mounted so that it and, of course, cam 170, at least partially embrace the vertical pivot axis P, that is, the vertical axis of air bearing 132. Preferably, such embracement should be less than 180 degrees. As a result, and as best seen in FIG. 5, irrespective of the rotary position of platform 140, crank pin 168, which now adopts the role of a cam follower, will always be in engagement with surface 172 of cam 170. Accordingly, the length of cam surface 172 corresponds to the travel desired for platform 140 about the pivot axis P.

It is apparent from a consideration of FIGS. 3 and 5 that as platform 140 is rotated about the vertical axis of air bearing spindle 130, cam follower 168 will experience vertical excursions as it traverses the length of surface 172 of the cam. These vertical excursions are converted, by the action of crank 166 and micrometer spindle 162, into radial displacements of the platform, relative to pivot axis P. Crank 166 and the micrometer thus constitute means responsive to displacement of cam follower 168 by cam surface 172 for selectively positioning platform 140 in the horizontal plane.

Rotation of platform 140 about the P axis serves to present the sides of the tool blank face to the grinding wheel. This rotation of the platform is preferably accomplished by means for rotating spindle 130 of air bearing 132 in a controlled to and fro fashion which, of course, also effects travel of cam follower 168 along cam surface 172.

More particularly, this means comprises a spindle drive motor 178, see FIG. 6, which is suspended beneath granite block 18 with its rotational axis coincident with pivot axis P, which, as previously noted, is coincident with the rotational axis of air bearing spindle 130. Motor 178 is secured to the underside of block 18 by a bracket 180 which is fastened to the motor's upper bell housing 182. The drive shaft 184 of the motor is fitted with a yoke 186 which, in turn, is spanned by a flexplate 188. The flexplate, in turn, is coupled to a stubshaft 190 depending from spindle 130. Motor 178 and its control are chosen to provide the required angular displacement and velocity. Such a motor and control may typically be a stepping motor combined with a programmable microprocessor, but other combinations, obvious to those skilled in the art, may be used. Such an arrangement thus imparts the desired angular displacement, or oscillation, to the motor shaft and, through stubshaft 190, to spindle 130, so that platform 140 is correspondingly rotated thereby driving cam follower 168 back and forth along cam surface 172.

In order to assist an operator to properly mount a diamond blank 118 in tool chuck 116 for presentation to grinding wheel 100, as well as to permit inspection of the profile of the blank during the grinding operation, an adjustable microscope 192 is provided. The microscope is mounted atop a pedestal 194 which, in turn, is secured to face 20 of granite block 18. In order that the microscope may be centered over the pivot axis P, the pedestal can adopt a goose neck configuration. Desirably a spotlight 196 is located to the left of work station 114 to illuminate the immediate vicinity of the tool blank and the grinding wheel.

Figure 4:
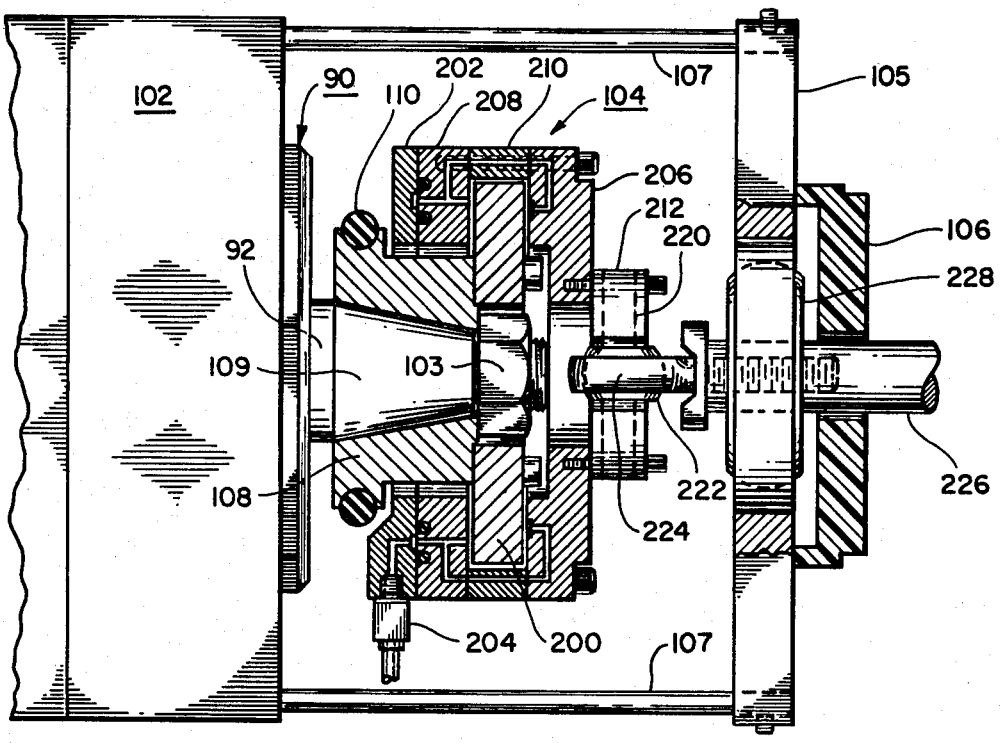
FIG. 4 is a fragmentary view partly in section, of the thrust air bearing fitted to the right hand end of the spindle assembly, as viewed in FIG. 2.

Turning now to the previously mentioned thrust air bearing 104, spherical bearing bracket 105 and skew limiter 106, as shown in the FIG. 4 sectional drawing, bearing 104 comprises an air bearing member 200 which is bolted to drive pulley hub 108 thereby directly connecting plate 200 to spindle journal 92. The purpose of this thrust bearing is to effect a stiff coupling between spindle journal 92 and apparatus for reciprocating that journal along its axis while still permitting the bearing to effectively float about spindle hub 108. As shown in FIG. 4, in order to achieve the aforementioned stiff coupling and bearing float, air bearing 104 adopts a sandwich construction which includes an annular end plate 202 having an air inlet port 204, a first air bearing member 206, which also serves as an end plate, a second air bearing plate 208 and a spacer ring 210. As shown in the drawing, end plate 202 and bearing plate 208 are centrally relieved to clear spindle hub 108 while spacer ring 210 is relieved to clear bearing member 200. Bearing plate 206 is relieved to clear the end of spindle journal 92, as well as the bolts employed to fasten bearing member 200 to hub 108. End plate 202 is fastened to and disposed in a confronting relation to bearing plate 208 so that air supplied to port 204 is communicated to plate 208 via a labyrinth of passages. Plate 208, in turn, communicates air to spacer ring 210 which, in turn, introduces air to bearing plate 206, again via a series of passages. The axial dimension of spacer ring 210 is selected so that when bearing plates 206, 208 and spacer ring 210 are fastened together as a unit, sufficient and proper clearances are established between the faces of plates 206, 208 that flank and confront bearing member 200. As a result, when compressed air is introduced to port 204, thrust bearing 104 will be enabled to effectively float about bearing member 200.

Suspension apparatus to assist air bearing 104 to maintain a floating relationship relative to the spindle hub 108, includes a U-shaped yoke 212, with the open end of "U" facing up, which yoke is bolted to bearing plate 206. The yoke is provided with a first transverse bore in which a pin, which is not visible, is secured. One end of a suspension spring 216 is received within the "U" opening and is fastened to this pin while its opposite, upper, end is fastened to a hanger arm 218 which is bolted to a flat on bracket 105, see FIG. 2. The tension in spring 216 is such that when air bearing 104 is under air pressure, the spring assures that the air bearing floats essentially weightlessly on push rod 226.

Yoke 212 further includes a second transverse bore in which a bearing support pin 220 is seated. A bearing-type coupler 222 has a central aperture that encircles pin 220 and an outer semi-spherical surface which is received within a correspondingly contoured opening in one end of a tie rod 224. The other end of tie rod 224 is threaded to one end of a push rod 226 which is connected to a reciprocator to be described.

In order to establish a universal type coupling between push rod 226 and thrust air bearing 104 bracket 105 is centrally apertured to receive a universal spherical bearing 228, which bearing is press fitted into the aperture. Bearing 228, in turn, receives and supports push rod 226. Thus, any tendency for push rod 226 to stray from exact axial alignment with spindle journal 92, is readily compensated for principally, by the universal coupling attributable to the spherical bearing 228 and, secondarily, by a universal-type coupling afforded by bearing type coupler 286 in cooperation with push rod 226.

Finally, in order to limit the extent of any axial misalignment between spindle journal 92 and push rod 226, the skew limiter 106 is provided. The limiter can adopt the form of a drum-like washer which is secured to bracket 105 and is centrally apertured to receive push rod 226. The diameter of this aperture exceeds the diameter of the push rod by that amount necessary to accommodate the axial misalignment that can be tolerated without damage to the system.

As previously noted, it is desirable that means be provided for uniformly distributing wear on the working surface of grinding wheel 100. To this end, and as best seen in FIG. 2, means are provided for effecting an axial reciprocation of spindle journal 92 while grinding wheel 100 is abrading the tool blank. This means comprises the reciprocator 234 which is coupled to spindle journal 92 via a push rod and thrust bearing 104 and to a counterpoise 236 via another push rod. Desirably, the counterpoise has a mass which is substantially equal to that of the spindle and grinding wheel and it is supported for reciprocating axial displacement which, at any instant, is opposite in direction to the displacement of the grinding wheel and its spindle. These simultaneous oppositely directed displacements serve to effect a cancellation of any vibration attendant upon reciprocation of the grinding wheel and its spindle assembly.

The reciprocating mechanism is mounted upon extension 14 of machine base 12. This extension is provided with a chassis 238 that supports a table 240 that has a surface section thereof ground flat for the purpose of receiving and supporting counterpoise 236. Disposed adjacent to counterpoise 236 is a guide bar 242 having a pair of air inlets 244. That side of guide bar 242 that confronts the counterpoise is fitted with a series of air outlets (not shown) which serve to establish an air film between that side of the guide bar and the immediately contiguous surface of the counterpoise.

Figure 1A:
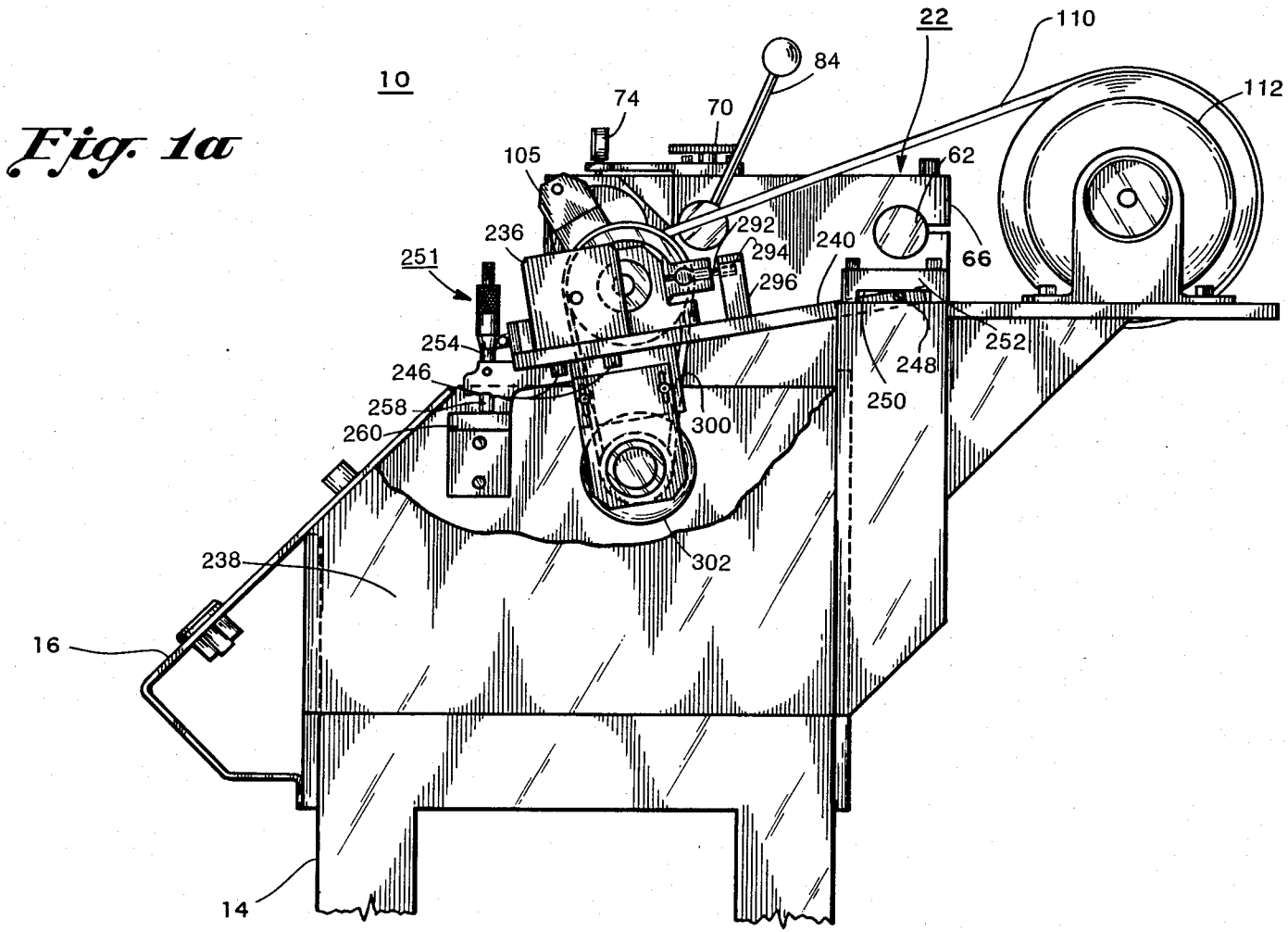
FIG. 1*a* is an end view of the apparatus shown in FIG. 1 depicting the drive arrangements for the apparatus.

Air is also introduced through the bottom of table 240 through an array of inlets 246, two of which are visible in FIG. 1*a*, to establish an air film between the flat ground surface section of the table and the underside of counterpoise 236. In this manner, during its reciprocation counterpoise 236 is supported upon a substantially horizontal air bearing while, as already noted, additional mobility is afforded by the lateral air bearing interposed between guide bar 242 and the contiguous surface of the counterpoise.

The back end of table 240 is provided with a pair of outwardly directed lugs 248 which are received within elongated rectangular slots 250 formed by the partially recessed blocks 252 which are individually and adjustably secured by bolts to the top of each side wall of chassis 238 to captivate lugs 248. In this fashion table 240 and reciprocator 234 are afforded pivotal rotation about lugs 248, as well as lateral displacement in a direction perpendicular to the axis of spindle journal 92. This lateral displacement of the table is limited to the travel afforded lugs 248 by their captivating slots 250.

In order to effect a vertical alignment between spindle journal 92 and push rod 226, associated with reciprocated 234, a third vertically disposed micrometer adjuster 251 is provided. Specifically, the barrel 254 of this micrometer is captivated in a mounting block 256 affixed to the front edge of table 240. The downwardly directed spindle 258 of the micrometer, see FIG. 1*a*, is brought to bear against a rail 260 that spans, and is anchored to, the side wall of chassis 238.

Accordingly, to achieve a complete axial alignment between spindle journal 92 and a reciprocator, the bolts captivating table lugs 248 are loosened to free table 240. At the same time clamp arm 84 is loosened to free wheelhead 60 for rotation about its shaft 62. However, prior to adjusting table 240 or the wheelhead, the system is coupled to the source of compressed air in order to establish all requisite air bearings. Thereafter, when the desired repositioning of wheelhead 60 is made, which, of course, repositions grinding wheel 100 with respect to tool blank 118, clamp arm 84 is rotated to lock the wheelhead in the selected position. Accordingly, with the system now on air, table 240 is moved forward or backward to effect an approximate alignment between spindle journal 92 and push rod 226. Then the thimble of micrometer 251 is adjusted to secure a vertical alignment between journal 92 and push rod 226. When a satisfactory alignment is achieved, blocks 252 are bolted down to the side wall of chassis 238 to immobilize table 240.

Figure 8:
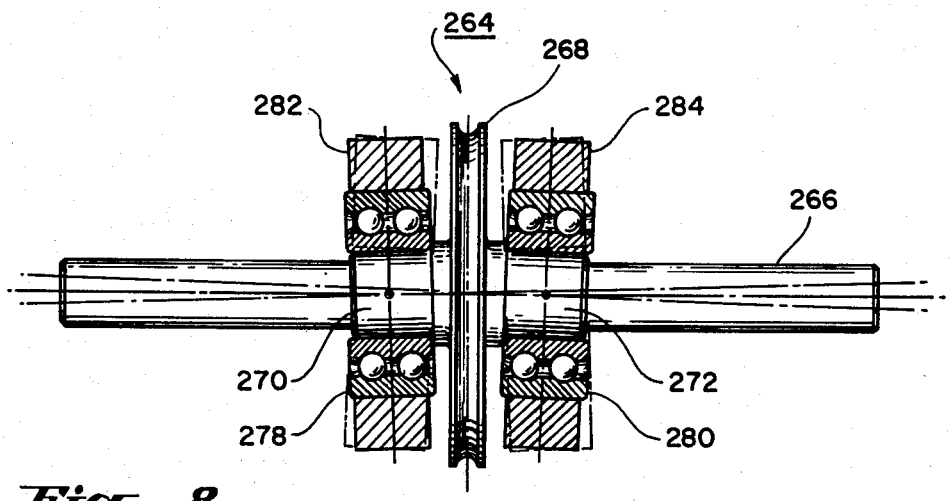
FIG. 8 is a detail of the wobble journal employed in the reciprocator depicted in FIG. 2.

Returning now to the details of reciprocator 234, the core of this apparatus is a wobble journal 264 comprising a central shaft 266 upon which a pulley section 268 is mounted, see FIG. 8. The axes of rotation of shaft 266 and pulley 268 are coincident. A pair of cylindrical shoulders 270, 272, flanking pulley 268 are, preferably, integrally formed on shaft 266. As seen in FIG. 8, both of these shoulders are canted outwardly from pulley 268, approximately the same amount, so that the central axes of shoulders 270, 272 are not coincident with the central axis of shaft 266. In fact, the axis of rotation of shoulder 270 intersects the axis of shaft 266 at approximately the geometric center of shoulder 270. By the same token, the axis of rotation of shoulder 272 intersects the axis of shaft 266 at approximately the geometric center of that shoulder. The included angle at these intersections is approximately one and one-half degrees.

As will be shown, this very asymmetry is utilized for converting the rotary motion of shaft 266 into oppositely directed lateral displacements of spindle journal 92 and counterpoise 236. The extremities of shaft 266 are supported for rotation upon table 240 by a pair of ball bearings which, while not visible in the drawings, can comprise Fafnir number 204 PD bearings, which are individually mounted in an assigned one of the bearing housings 274, 276. As shown in FIG. 2 these housings are bolted to table 240.

Referring back to FIG. 8, each of asymmetrical shoulders 270, 272 is encircled by one of the pair of double race ball bearings 278, 280, respectively. Surrounding the outer race of each of bearings 278, 280 is an assigned one of the C-shaped wobble yokes 282, 284. As shown in FIG. 2, yoke 282 is clamped about the outer race of bearing 278 by closing its open end with a threaded fastener that also captivates the eyelet end of a tie bar 286. This tie bar is threaded to that end of push rod 226 remote from air bearing 104. In like fashion, yoke 284 is clamped about the outer race of bearing 280 by closing its open end with a threaded fastener that also serves to captivate the eyelet end of a tie bar 288 which is threaded to one end of a push rod 290. The other end of push rod 290 is coupled to counterpoise 236.

As seen in FIG. 1*a* the oppositely disposed closed-end of each of yokes 282, 284 is provided with a rearwardly extending pin 292 which is inserted in the recess 294 formed in an anti-rotation block 296 which, in turn, is fastened to table 240. Wobble journal 264 is driven by a belt 300 which couples its pulley section 268 to an electric motor 302, which is conveniently mounted underneath table 240.

The manner in which reciprocator 234 serves to convert the rotational energy of wobble journal 264 into lateral displacements of push rod 226 and 290 will now be developed. Referring to FIG. 8 and directing attention initially to the positions of shoulders 270, 272 as depicted by their full-line illustrations, it will be appreciated that as shaft 266 rotates, the integrally formed shoulders must, of necessity, also rotate. Accordingly, as shaft 266 rotates within its end-mounted bearings, which are not shown in FIG. 8, shoulders 270, 272 are free to rotate within the inner race of their respective bearings 278, 280. However, unlike shaft 266, which has a fixed axis of rotation, the axes of rotation of the shoulders constantly change as the shoulders, and their bearings, cant from their full line depictions to their broken-line depictions in response to rotation of shaft 266. These shifting axes of rotation of shoulders 270, 272 are graphically illustrated in FIG. 8. As a result, shoulders 270, 272 exhibit transverse displacement, as well as rotational displacement.

Now, while the inner race of each of these bearings is free to rotate with its associated shoulder, the outer race of each bearing is clamped by its assigned yoke, which, in turn, are prevented from rotating since their pins 292 are captivated in anti-rotation block 296. However, while yokes 282, 284 cannot rotate, they are free to, and do, adopt the transverse displacements of their assigned shoulders as they, the shoulders, rotate. These transverse displacements of yokes 282, 284 are communicated to their assigned push rods 226, 290, respectively, and, as evident from a consideration of the foregoing discussion and a study of FIG. 8, are always oppositely directed. Accordingly, and with reference to FIG. 2, at any instant that push rod 226 drives air bearing 104 and spindle journal 92 to the left, push rod 290 will drive counterpoise 236 to the right, thereby cancelling any vibration that might arise from the reciprocation of spindle journal 92 and the grinding wheel.

The operation of grinding apparatus 10 to form a complex profiled face on a diamond tool blank would, in general, proceed as follows. A cam 170 having a contour developed from an algorithm representative of the profile desired for the tool blank is mounted in cam holder 174. The shank 120 of a diamond blank 118 is temporarily inserted in tool chuck 116, but not yet secured. The appropriate controls on panel 16 are then actuated to establish all air bearings, specifically, the bearing supporting wheelhead assembly 22, grinding spindle air bearing assembly 90, thrust air bearing 104, the pivot axis air bearing 132, the beam 138/chamber 144 air bearing and the horizontal and lateral air bearings that support counterpoise 236. Air cylinder 42 is also energized to drive wheelhead assembly 22 forward to bring its baseplate 24 to bear against micrometer spindle 56, maintaining a pivot-to-grinding wheel distance as determined when computing the cam algorithm.

The end of tool blank 118 is then sighted through microscope 192 and the blank is adjusted while platform 140 is rotated. When a satisfactory presentation of the tool blank is made, relative to the grinding wheel, the blank is locked in the chuck.

If desired, an additional degree of control of grinding spindle assembly 68 is available in that the elevation of spindle assembly 68, relative to tool chuck 116, can be selected by first turning arm 84 to release the clamping pressure of end walls 64, 66 upon wheelhead 60. The wheelhead is now free to rotate about its shaft 62 and a desired elevation of the spindle assembly is selected by adjusting knurled knob 70 until that elevation registers on height gauge 74. Arm 84 is then readjusted to clamp wheelhead 60 between walls 64 and 66.

The alignment between push rod 226, associated with reciprocator 234, and thrust air bearing 104 of the grinding spindle is then checked. If horizontal alignment is not satisfactory, then blocks 252 are loosened and an adjustment is made in the manner already described. Likewise, if the elevational alignment between push rod 226 and the air bearing requires correction, micrometer 251 is adjusted.

Apparatus 10 is now ready for a grinding operation. Motors 112 and 302 are energized to rotate grinding spindle journal 92 and reciprocator wobble journal 264, respectively. With all air bearings now established, reciprocator 234 will reciprocate the spinning grinding wheel 100 along its rotational axis in the work station to commence grinding the tool blank. When it is determined that a satisfactory grinding contact between the wheel and the blank is established, motor 178 is energized to oscillate the spindle of air bearing 132, through controlled arcuate displacements and, of course, platform 140 which is supported thereon. This arcuate rotation of the platform drives cam follower 168 back and forth along cam surface 172, in the manner previously detailed.

As previously noted, the contour of cam surface 172 determines the radial incursions of platform 140 and, of course, the corresponding presentations of diamond blank 118 to the grinding wheel. In order to form a complex profiled face on the diamond blank 118, the invention provides a compound grinding action. This action is readily demonstrated if a cam having a linear, that is constant elevation, surface is first selected for engaging cam follower 168. Such a cam can readily be perceived and therefore has not been illustrated. Then, as platform 140 is oscillated by spindle drive motor 178, follower 168 is propelled back and forth along this linear cam surface while the platform supported tool holder 116 presents the sides of the tool blank to the grinding wheel. Since the path of the follower along a linear cam defines a plane, displacement of crank 166 is also confined to a plane so that no rotation of micrometer thimble 164 will take place. As a result, there will be not radial displacement of platform 140 and the profile ground on the face of the tool blank 118 will be a simple radius.

On the other hand, when a cam having a contoured surface, for example, one of the devices illustrated in FIGS. *7a* and *7b*, is inserted in cam holder 174 and follower 168 is now propelled back and forth along that surface, a compound grinding-action takes place. More particularly, each time the follower rises or falls in response to contoured surface 172, the resulting vertical displacement will be translated by micrometer spindle 162, via crank 166 and thimble 164, to radial displacements of platform 140. As a result, tool blank 118 will experience inward or outward radial displacements in concert with the undulations of the cam surface. The face now ground on the tool blank will no longer resemble a simple radius but rather a complex profile face that, in general, can be described by a polynominal. An example of such a face is depicted in the FIG. *9a* enlargement of the tool shown in FIG. 9.

In conclusion, it will be noted that the cam follower can always be manually lifted from the cam surface to withdraw the diamond from contact with the grinding wheel or lapping wheel. This is both a convenience for the operator and a fail-safe feature.

While a particular embodiment of the invention has been shown and described, it will be obvious to those skilled in the art that changes and modifications may be made without departing from the invention in its broader aspects, and, therefore, the aim of the appended claims is to cover all such changes and modifications as falling within the true spirit and scope of the invention.

We claim:

1. An ultra precise apparatus for forming a complex profiled face on a tool blank, said apparatus comprising:

an abrading device;

spindle means comprising a journal for supporting said abrading device;

first gaseous lubricant bearing means for rotatably supporting said journal;

a platform supported (1) for rotation about a predetermined fixed pivot axis and (2) for displacement in a two-dimensional plane disposed perpendicular to said fixed pivot axis;

second gaseous lubricant bearing means for supporting said fixed platform for rotation about said pivot axis;

third gaseous lubricant bearing means for supporting said platform for displacement in said two-dimensional plane;

chuck means, mounted upon said platform, for holding said tool blank and for presenting said tool blank to said abrading device;

cam means disposed adjacent said platform and having a surface of a predetermined contour related to the profile of said complex profiled face to be formed on said tool blank;

cam follower means supported for engagement with said cam surface;

means responsive to displacement of said cam follower means by said cam surface for selectively positioning said platform in said two-dimensional plane along a platform axis orthogonally intersecting said fixed pivot axis; and means for rotating said platform about said predetermined fixed pivot axis and for effecting a relative travel between said cam follower means and said cam surface to selectively position said platform in said two-dimensional plane along said platform axis while said tool blank is presented to said abrading device, thereby causing said abrading device to generate said complex profiled face on said tool blank.

2. Apparatus in accordance with claim 1 which further includes:

means for effecting axial reciprocation of said spindle journal for uniformly distributing wear on the working surface of said abrading device;

counterpoise means coupled to said reciprocating means and supported for simultaneous reciprocating axial displacement, but in a direction opposite to that of said spindle journal, to effect a cancellation of any vibration attendant upon reciprocation of said spindle means; and fourth gaseous lubricant bearing means for supporting said counterpoise means during reciprocating axial displacement thereof.

3. Apparatus in accordance with claim 1 in which said platform is supported for rotation about a vertically disposed fixed pivot axis and in which each of said gaseous lubricant bearing means comprises an air bearing.

4. Apparatus in accordance with claim 1 in which said cam means surface has a contour developed from an algorithm representative of said complex profiled face.

5. Apparatus in accordance with claim 4 in which said cam means surface has a length corresponding to the travel of said platform about said predetermined fixed pivot axis and an elevation that determines the positioning of said platform along said platform axis in said two-dimensional plane.

6. Apparatus in accordance with claim 2 in which said counnterpoise has a mass substantially equal to that of said spindle means and said abrading device.

* * * * *